US007025002B2

(12) United States Patent
Cummings

(10) Patent No.: US 7,025,002 B2
(45) Date of Patent: Apr. 11, 2006

(54) RAILWAY BOGIE BOLSTER FOR AN ARTICULATED WAGON

(75) Inventor: Douglas Gordon Cummings, Coal Point (AU)

(73) Assignee: Bradken Resources Pty Limited, New South Whales (AU)

( * ) Notice: Subject to any disclaimer, the term of this patent is extended or adjusted under 35 U.S.C. 154(b) by 0 days.

(21) Appl. No.: 10/410,728

(22) Filed: Apr. 10, 2003

(65) Prior Publication Data

US 2003/0226471 A1 Dec. 11, 2003

(30) Foreign Application Priority Data

Apr. 10, 2002 (AU) ..... PS1657

(51) Int. Cl.
*B61F 5/00* (2006.01)

(52) U.S. Cl. ..... 105/4.1; 105/199.3

(58) Field of Classification Search ..... 105/226, 105/227, 228, 229, 230, 199.3, 4.1, 4.2, 4.3, 105/3

See application file for complete search history.

(56) References Cited

U.S. PATENT DOCUMENTS 1,456,839 A * 5/1923 Westlake ..... 105/4.1
1,608,665 A * 11/1926 Pehrson ..... 105/4.1
1,912,563 A * 6/1933 Allison ..... 384/368
2,108,733 A * 2/1938 Udstad ..... 105/4.1
3,216,370 A * 11/1965 Kulieke ..... 105/4.1
4,751,882 A * 6/1988 Wheatley et al. ..... 105/4.1
5,207,161 A * 5/1993 Pileggi et al. ..... 105/4.1
6,354,226 B1 * 3/2002 Stecker ..... 105/226

* cited by examiner

*Primary Examiner*—Mark T. Le
(74) *Attorney, Agent, or Firm*—Timothy J Keefer; Seyfarth Sahw LLP

(57) ABSTRACT

A bolster 14 for a bogie of an articulated railway wagon is shown including supports for constant contact sidebearers in the form of two pairs of brackets such as 26A and 26B being integral with the bolster 14 at its opposing respective ends. The brackets such as 26A are each adapted for fixing of the constant contact sidebearers which in turn are arranged to contact a corresponding wear plate mounted to an articulated connector 50. In a preferred example the corresponding wear plates are mounted to corresponding brackets 52A, 52B which are cast integral with respective male or female articulated connector components 54 or 56. Each bracket 26A/B extends laterally from the bolster 14 and, when viewed in plan, each bracket 26A/B has a longitudinal axis of symmetry which is orthogonal to a radius from a central rotational point of the articulated connector 50 of the railway wagon.

9 Claims, 2 Drawing Sheets

RAILWAY BOGIE BOLSTER FOR AN ARTICULATED WAGON

FIELD OF THE INVENTION

The present invention relates generally to a bogie for an articulated railway wagon and relates particularly, though not exclusively, to a bolster of the bogie.

BACKGROUND TO THE INVENTION

In a conventional articulated railway freight train, adjacent wagons are mounted at adjacent ends to an interconnecting railway bogie. The bogie includes a pair of side frames spaced apart by a bolster on which the wagons are mounted via an articulated connector. The articulated connector is provided by mating male and female components of the articulated connector which are respectively welded into the sill of adjacent wagons. The wagons at adjacent ends each include a pair of outriggers and sidebearer wear plates which contact corresponding constant contact sidebearers which in turn are mounted on the bolster of the bogie or on brackets attached to the bolster of the bogie. The corresponding sidebearer brackets are either cast or weld/fabricated separate of the bolster and thereafter welded or bolted to the bolster. For example in U.S. Pat. No. 5,207,161 and U.S. Pat. No. 4,751,882 the sidebearings are mounted to the bolster via a side bearing foundation or side beam which is seated on top of and projects above the bolster. In these documents the sidebearings are oriented in an angled radial mounting position.

SUMMARY OF THE INVENTION

In a first aspect the present invention provides a bolster for a bogie of an articulated railway wagon, the bolster comprising two or more integral brackets, each bracket being adapted for fixing of a constant contact sidebearer, the sidebearer arranged to contact a corresponding wear plate mounted to an articulated connector on one of adjacent railway wagons which can be mounted in an articulated manner to the bogie via the bolster. Preferably the brackets are cast to be integral with the bolster.

An advantage of a bolster having integral brackets is that the inherent strength of the bolster is increased compared to the known prior art arrangements where a welding or other joining method is utilised to join the brackets thereto. The bolster can thus be made of thinner material and can therefore be lighter overall. Because no joining or welding of the brackets to the bolster is required, the bolster of the invention is also simpler and cheaper to make because of the reduced number of manufacturing steps required. For example, the bolster can be cast in a single step.

Preferably the bolster has four brackets arranged in the form of two pairs of flanged outstands, each pair being disposed at respective ends on either side of and extending laterally from the bolster, the outstands each being adapted for fixing of the constant contact sidebearer.

Preferably in plan view of the bolster and with reference to a central rotational point between the articulated connectors, each flanged outstand is radially aligned with a corresponding wear plate.

Preferably when the bolster is viewed in plan, and with reference to a radius from a central rotational point between the articulated connectors, each bracket is arranged to be lengthwise transverse to the radius. More preferably each bracket has a longitudinal axis of symmetry which is orthogonal to the radius.

Preferably the brackets include one or more strengthening ribs connected between an underlying surface of each of the flanged outstands and an adjacent surface of the bolster to support each outstand. More preferably the brackets include two longitudinally spaced and laterally extending strengthening ribs.

Preferably the bolster is hollow and its wall thickness is increased in the vicinity of each bracket and in a zone of stress concentration. More preferably the bolster includes one or more openings in its sidewall.

In a second aspect the present invention provides a bolster for a bogie of an articulated railway wagon, the bolster comprising two or more brackets, each bracket extending laterally from the bolster and being adapted for fixing of a constant contact sidebearer, the sidebearer arranged to contact a corresponding wear plate mounted to an articulated connector on one of adjacent railway wagons which can be mounted in an articulated manner to the bogie via the bolster.

An advantage of a bolster having laterally extending brackets is that the distance by which the constant contact sidebearers are spaced from the a central rotational point where the articulated connectors are joinable to the bolster is increased compared to the known prior art arrangements, where brackets for the sidebearers are seated atop the bolster. This increased spacing between the rotational point and sidebearers increases the stability afforded by the sidebearers as the articulated connectors of adjacent railway wagons rotate about the rotational point in use, for example when the wagons negotiate a curve which causes wagon body lean. The brackets can be arranged to laterally extend from the bolster at any angle from an axial centreline of the bolster, thus providing a wide range of angles between brackets (and thus the constant contact sidebearers that are located thereon in use), further increasing the stability afforded by the sidebearers.

Preferably the bolster of the second aspect is otherwise as defined in the first aspect.

In a third aspect the present invention provides a bolster for a bogie of an articulated railway wagon, the bolster when viewed in plan comprising two or more brackets, each bracket having a longitudinal axis of symmetry which is orthogonal to a radius from a central rotational point of an articulated connector of the railway wagon, each bracket being adapted for fixing of a constant contact sidebearer, the sidebearer arranged to contact a corresponding wear plate mounted to an articulated connector of the wagon or of an adjacent wagon.

An advantage of a bolster having brackets arranged orthogonal to a radial line extending the from central rotation point of the bolster is that the stability afforded by the sidebearers when mounted to the brackets can be maximised as the articulated connector/s of one or more adjacent railway wagons rotate about the rotational point in use, for example when the wagons negotiate a curve which causes wagon body lean. Such an orthogonal alignment of sidebearers in use reduces the shear and maximises the sliding action between a sidebearer and a wear plate located on a rotating wagon because the relative movement between these components is along the longitudinal axis of symmetry of the bracket and the aligned sidebearer, thus making it easier for the wagon to rotate and the rotation more stable.

Preferably the bolster of the third aspect is otherwise as defined in the first aspect.

In a fourth aspect the present invention provides a bogie for an articulated railway wagon, the bogie comprising:

a bolster mounted between a pair of side frames and adapted to provide articulated mounting of adjacent railway wagons; and two or more brackets being integral with the bolster, each bracket adapted for fixing of a constant contact sidebearer, the sidebearer arranged to contact a corresponding wear plate mounted to an articulated connector on one of the adjacent wagons.

Preferably the bolster of the fourth aspect is otherwise as defined in either the first, second or third aspects.

In a fifth aspect the present invention provides a bogie for an articulated railway wagon, the bogie comprising:

a bolster mounted between a pair of side frames and adapted to provide articulated mounting of adjacent railway wagons; and two or more brackets, each bracket extending laterally from the bolster and being adapted for fixing of a constant contact sidebearer, the sidebearer arranged to contact a corresponding wear plate mounted to an articulated connector on one of adjacent railway wagons.

Preferably the bolster of the fifth aspect is otherwise as defined in either the first, second or third aspects.

In a sixth aspect the present invention provides a bogie for an articulated railway wagon, the bogie comprising:

a bolster mounted between a pair of side frames and adapted to provide articulated mounting of adjacent railway wagons; and two or more brackets arranged on the bolster such that, when viewed in plan, each bracket has a longitudinal axis of symmetry which is orthogonal to a radius from a central rotational point of an articulated connector of the railway wagon, each bracket being adapted for fixing of a constant contact sidebearer, the sidebearer arranged to contact a corresponding wear plate mounted to an articulated connector of the wagon or of an adjacent wagon.

Preferably the bolster of the sixth aspect is otherwise as defined in either the first, second or third aspects.

BRIEF DESCRIPTION OF THE DRAWINGS

In order to achieve a better understanding of the nature of the present invention a preferred embodiment of a bogie of an articulated railway wagon will now be described in some detail, by way of example only, with reference to the accompanying drawings in which.

DETAILED DESCRIPTION OF THE PREFERRED EMBODIMENT

Figure 1A:
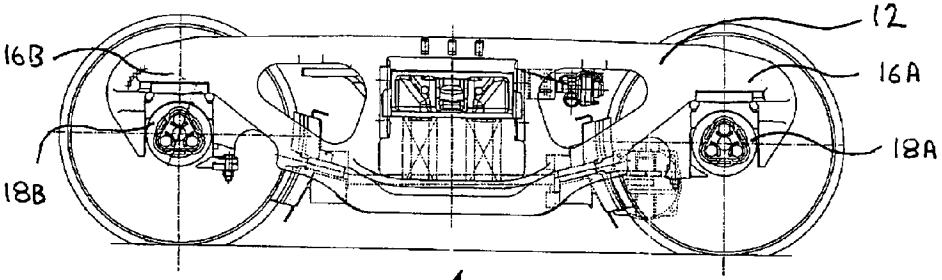
FIG. 1*a* is a bogie of an articulated railway wagon in accordance with the invention, the bogie shown in side elevation.
Figure 1C:
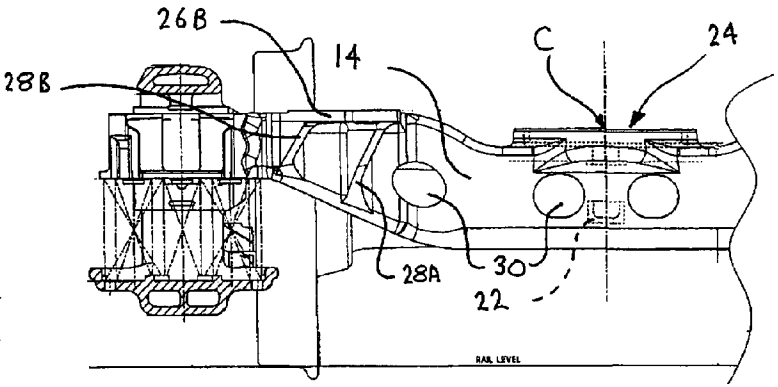
FIG. 1*c* is the bogie of FIG. 1*a* shown in part end elevational view.
Figure 1B:
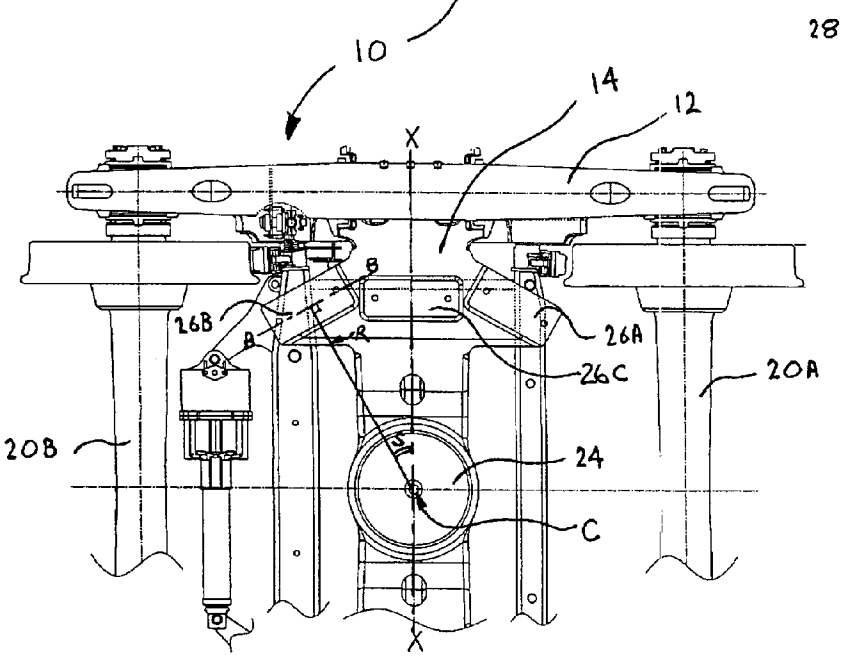
FIG. 1*b* is the bogie of FIG. 1*a* shown in part plan view.

As shown in the side elevational view of FIG. 1*a* and plan view of FIG. 1*b* there is a bogie 10 of an articulated railway wagon (not shown), the bogie 10 comprising a pair of side frames such as 12 spaced apart by a bolster 14. The side frames 12 are each trapezium-shaped and at their opposing ends include a pair of respective pedestal legs which define downwardly facing pedestal jaws 16A and 16B. The pedestal jaws 16A/B provide mounting for respective bearings 18A/B in which an axle/wheel set 20A/B is rotationally mounted. The bolster 14 is sprung mounted at its opposing ends within each of the respective side frames such as 12 and provides for articulated mounting of adjacent railway wagons (not shown).

As shown in the hidden detail of the part end view of FIG. 1*c*, the bolster 14 includes a centre pin block 22 which is cup-shaped and aligned with an aperture in a centre bowl 24 of the bolster 14. The adjacent railway wagons or their skeletal body (not shown) are welded to the articulated connector 50 of FIG. 2. The articulated connector 50 is pivotally mounted to the bolster 14 via a centre pin (not depicted) at the centre bowl 24 centrepoint location C. The centre pin passes through aligned holes in the articulated connector 50 and the centre bowl 24 and centre pin block 22.

Figure 2:
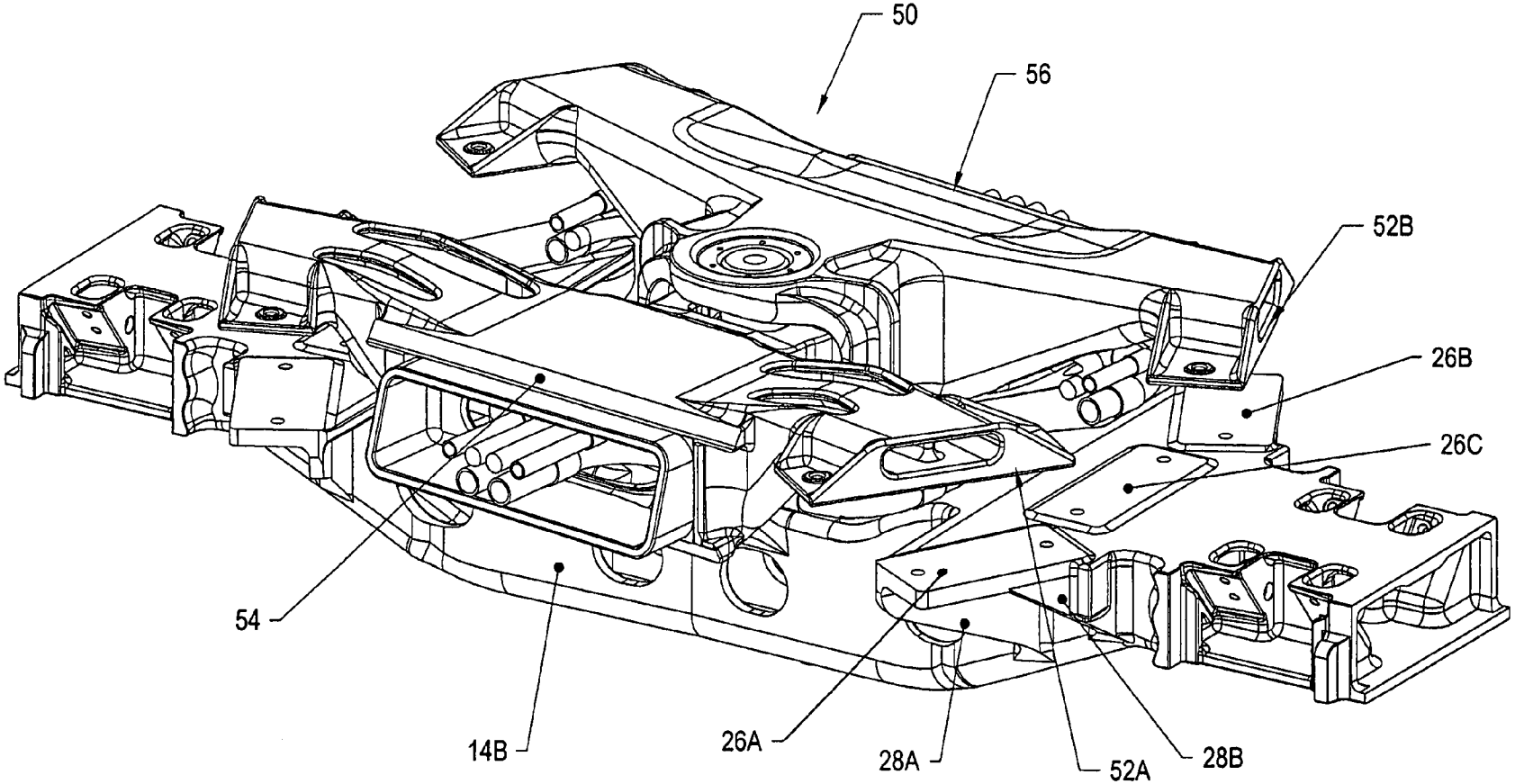
FIG. 2 is a perspective view of an articulated railway bogie connector together with the bogie of FIG. 1.

In this embodiment of the invention the bolster 14 as best shown in FIG. 2 includes supports for constant contact sidebearers in the form of two pairs of brackets such as 26A and 26B being integral with the bolster 14 at its opposing respective ends. The brackets such as 26A are each adapted for fixing of the constant contact sidebearers (not illustrated) which in turn are designed to contact a corresponding wear plate mounted to one of the adjacent wagons or the articulated connector 50. In this example the corresponding wear plates (not shown) are mounted to corresponding brackets 52A, 52B which are cast integral with respective male or female articulated connector components 54 or 56. The male and female articulated connector components 54/56 each include a pair of the corresponding brackets such as 52A/B to which the corresponding wear plates are mounted.

In the embodiment shown in FIG. 1*b*, there is a further support for a constant contact sidebearer in the form of a bracket 26C being integral with the bolster 14 and located between the bracket pair 26A/B. The bracket 26C is also adapted for fixing of a constant contact sidebearer (not illustrated) which may be fitted in some situations in addition to or as an alternative to the angled brackets 26A/B, for example at the end wagon of a wagon train if there is no adjoining wagon (a headstock bogie).

The constant contact sidebearers used with the bolster of the invention are a proprietary item which can be purchased commercially and are well known in the art, for example that manufactured by Stucki Co, USA. These bearers usually include a roller and a rubber spring component arranged in a housing. The use of any suitable type of constant contact sidebearer is within the scope of the invention.

The brackets 26A/B of the bolster 14 are in this particular construction are cast integral with the bolster 14. However, in an alternative embodiment, it is possible that the brackets may be otherwise formed integral with the bolster 14 so as to be of the same mass of material. The advantage of a bolster having integral brackets is that the inherent strength of the bolster is increased compared to the known prior art arrangements where a welding or other joining method is utilised to join the brackets thereto. The bolster can thus be made overall of thinner material and can therefore be lighter.

The brackets 26A/B are in the form of a pair of flanged outstands disposed either side of and laterally extending from the bolster 14. The flanged outstands such as 26A/B are radially aligned with the corresponding wear plate of the adjacent wagon or articulated connector of FIG. 2. In order to provide additional strength to the brackets or flanged outstands such as 26A/B, a pair of strengthening ribs 28A and 28B are provided. The ribs such as 28A are connected between an underlying surface of the flanged outstand such as 26B and an adjacent surface of the bolster 14. The pair of strengthening ribs 28A/B are longitudinally spaced along and laterally extend from the bolster 14.

By having flanged outstands which laterally extend from the bolster 14, the distance by which the constant contact sidebearers are spaced from the central rotational point C is able to be increased, when compared to the known prior art arrangements where brackets for the sidebearers are seated atop the bolster. This increased spacing between the rotational point C and sidebearers can increase the stability afforded by the sidebearers as the articulated connectors of adjacent railway wagons rotate in use, for example when the wagons negotiate a curve which causes wagon body lean. In the preferred embodiment, the flanged outstand brackets can be arranged to laterally extend from the bolster so that the brackets can typically be oriented 30–45 angle degrees from the axial centreline X of the bolster 14. When the brackets are widely spaced apart, this further increases the stability afforded by the sidebearers.

The bolster 14 is generally hollow in construction and its wall thickness is increased in the vicinity of the brackets or flanged outstands 26A/B. This thickening in the wall of the bolster is understood to reduce the stress concentration in this area of the bolster 14. The bolster 14 also includes one or more openings or access holes 30. These access holes 30 provide access internally of the hollow bolster 14 which may for example be beneficial in maintenance and servicing of the railway bogie 10.

In operation the constant contact sidebearers mounted to the integral brackets such as 26A/B are designed to contact the corresponding wear plates fixed to the articulated connector of FIG. 2. As a result of the radial alignment of the corresponding brackets and wear plates, this contact is maintained during articulation of the adjacent wagons and the articulated connector 50. Referring to FIG. 1*b*, when the bolster 14 is viewed in plan, the radial line R shown extending from a central rotational point C in the centre bowl 24 between the articulated connectors 54/56 is orthogonal to a line B which represents the axis of symmetry of bracket 26B. The advantage of this orthogonal position is that the stability afforded by the sidebearers when mounted to the brackets can be maximised when the wagons negotiate a curve which causes wagon body lean. The orthogonal alignment of sidebearer in use reduces the shear and maximises the sliding action between a sidebearer and a wear plate located on a rotating wagon because the relative movement between these components is along the longitudinal axis of symmetry B of the bracket 26A/B and the aligned sidebearer, and therefore the relative rotation of the wagon/s becomes easier.

As shown in FIG. 1*b*, in the preferred embodiment of the bolster, the flanged outstand brackets 26A/B are oriented by an angle S of 30 angle degrees between the radial line R extending from a central rotational point C in the centre bowl 24 of the bolster and the axial centreline X of the bolster.

Under normal working conditions and as a result of draft and buff loads as well as rock and roll and bounce, the corresponding wear plates and brackets will experience relative movement or vertical travel of typically around 6 to 8 mm, which the constant contact sidebearers are arranged to absorb. It is understood that the resultant stresses in the brackets or flanged outstands of the described embodiment of the invention may under these normal operating conditions be in the range of 250 to 550 MPa. Although the material selection for the bolster and/or articulated connector may vary it should be suitable for these stresses. The specific configuration of the preferred bolster and articulated connector described lend themselves to casting and preferably the material should be suitable for casting and subsequent heat treatment.

Now that a preferred embodiment of the invention has been described in some detail it will be apparent to those skilled in the art that the bogie of the articulated railway wagon and in particular the bolster of the bogie has at least the following advantages:

i) the bolster can be fabricated/constructed as a unitary structure including the integral brackets for improved strength;

ii) the use of laterally extending brackets can allow fabrication of a bolster with a wide angle between brackets so as to increase the stability provided by the sidebearers when fitted to the brackets in use; and iii) the bogie in its preferred form operates effectively with an articulated connector wherein the constant contact sidebearers are radially aligned in a manner so as to minimise shear.

Those skilled in the art will appreciate that the invention described herein is susceptible to variations and modifications other than those specifically described. For example, the corresponding wear plates need not be mounted to the articulated connector but rather may be mounted to the wagons. Any shape of bracket is also within the scope of the invention, and need not be restricted to the rectangular-faced brackets of the preferred embodiment. Any type of proprietary constant contact sidebearer can be used with the invention which is of suitable shape and performance characteristics.

All such variations and modifications are to be considered within the scope of the present invention the nature of which is to be determined from the foregoing description.

It is to be understood that, if any prior art information is referred to herein, such reference does not constitute an admission that the information forms a part of the common general knowledge in the art in any country.

What is claimed is:

1. A bolster for a bogie of an articulated railway wagon, the bolster comprising four brackets in the form of flanged outstands, with a bracket being disposed on either side of a respective end of and extending laterally from the bolster, each bracket being integrally formed with the bolster and each bracket being disposed so as to fix a constant contact sidebearer, where the sidebearer is arranged so as to contact a corresponding wear plate mounted to an articulated connector on one of adjacent railway wagons and the adjacent wagons being mountable in an articulated manner to the bogie via the bolster, wherein when the bolster is viewed in plan, and with reference to a radius from a central rotational point between the articulated connectors, each bracket is elongate and arranged to be lengthwise transverse to the radius.

2. A bolster as claimed in claim 1 wherein the brackets are cast so as to be integrally formed with the bolster.

3. A bolster as claimed in claim 1 wherein in plan view of the bolster and with reference to a central rotational point between the articulated connectors, each flanged outstand is radially aligned with a corresponding wear plate.

4. A bolster as claimed in claim 1 wherein each bracket has a longitudinal axis of symmetry which is orthogonal to the radius.

5. A bolster as claimed in claim 1 wherein the brackets include one or more strengthening ribs connected between an underlying surface of each of the flanged outstands and an adjacent surface of the bolster to support each outstand.

6. A bolster as claimed in claim 5 wherein the brackets include two longitudinally spaced and laterally extending strengthening ribs.

7. A bolster as claimed in claim 1 that is hollow wherein its wall thickness is increased in the vicinity of each bracket.

8. A bolster as claimed in claim 1 wherein the bolster includes one or more openings in its sidewall.

9. A bogie for an articulated railway wagon, the bogie comprising:

a bolster mounted between a pair of side frames and adapted to provide articulated mounting of adjacent railway wagons; and four brackets in the form of flanged outstands, with a bracket being disposed on either side of a respective end of and extending laterally from the bolster, each bracket being integrally formed with the bolster and each bracket disposed so as to fix a constant contact sidebearer, where the sidebearer is arranged so as to contact a corresponding wear plate mounted to an articulated connector on one of the adjacent wagons wherein when the bolster is viewed in plan, and with reference to a radius from a central rotational point between the articulated connectors, each bracket is elongate and arranged to be lengthwise transverse to the radius.

* * * * *